United States Patent [19]

Martin

[11] 4,027,115

[45] May 31, 1977

[54] ELECTROACOUSTIC SOUND GENERATOR

[75] Inventor: Erwin Martin, Munich, Germany

[73] Assignee: Siemens Aktiengesellschaft, Munich, Germany

[22] Filed: Mar. 22, 1976

[21] Appl. No.: 669,162

Related U.S. Application Data

[63] Continuation of Ser. No. 359,894, May 14, 1973, abandoned.

[30] Foreign Application Priority Data

May 15, 1972 Germany ..... 2223531

[52] U.S. Cl. ..... 179/179

[51] Int. Cl.² ..... H04R 1/28

[58] Field of Search ..... 179/182 R, 179, 178, 179/115 R; 181/31 R

[56] References Cited

UNITED STATES PATENTS

| | | | |
|---|---|---|---|
| 1,646,628 | 10/1927 | Nolen | 179/182 R |
| 2,236,568 | 4/1941 | Edson | 179/182 R |

FOREIGN PATENTS OR APPLICATIONS

| | | | |
|---|---|---|---|
| 715,926 | 12/1931 | France | 181/31 R |
| 35,869 | 3/1926 | Denmark | 179/182 R |

*Primary Examiner*—Thomas W. Brown
*Attorney, Agent, or Firm*—Gerald L. Lett

[57] ABSTRACT

An electroacoustic sound generator of the type having a diaphragm vibrating in the audio frequency range is described. The diaphragm is mounted in a housing which is constructed to form first and second volumes, the former being smaller than the latter. The housing has channels formed therein for communicating sonic energy to the exterior from the first interior volume portion. The first volume portion together with the channels form a Helmholtz resonator tuned to the frequency of the sonic energy to be radiated. The resonant frequency is determined by the product of the compliance of the first volume and the square of the ratio of the cross-sectional area of a channel to the surface area of the diaphragm.

5 Claims, 5 Drawing Figures

ELECTROACOUSTIC SOUND GENERATOR

This is a continuation of application Ser. No. 359,894, filed May 14, 1973, now abandoned

BACKGROUND OF THE INVENTION

This invention relates to electroacoustic sound generators. More particularly, the invention is concerned with electroacoustic generators having a diaphragm that vibrates within the range of audibility and is provided with a piezoelectric layer.

As is well known, conventional mechanical sound generators cannot be employed in apparatuses of small physical size because of their dimensions and wieghts. This raises obvious problems for the construction of telephone equipment.

It is, therefore, an object of the invention to provide a sound generator having small dimensions and light weight.

SUMMARY OF THE INVENTION

In accordance with the invention, the foregoing and other objects are achieved in that the diaphragm is disposed in a housing provided with sound outlet channels such that the part by volume of the housing facing the sound outlet channels is small compared to the remaining part by volume of the housing. Together with the sound outlet channels the former volume portion forms a Helmholtz resonator tuned to the frequency of the sonic vibration to be radiated. In order to determine the resonant frequency the transformed compliance of the first-mentioned volume portion is the determinative factor. More particularly the resonant frequency is a function of the compliance multiplied by the square of the quotient of the cross-sectional area of the outlet channels and of the diaphragm interconnecting the two volume portions.

Compared to sound generators of known construction, the sound generator according to the invention has the advantage, first of all, that for the operation thereof essentially only one component is required. That component is in the form of a diaphragm provided with a piezoelectric layer. Hence, the sound generator is of a very light weight. It is to be noted that a repeater connected thereto would change the weight ratios only insignificantly.

Furthermore, the overall height of the sound generator according to the invention is small, since the portion of the volume of the housing facing the sound outlet channels is small compared with the remaining part, by volume, of the housing. Thus, this type of sound generator can, for example, be installed in a small telephone subscriber set or the like.

It is advantageous that the frequency of the fundamental vibration of the diaphragm corresponds to the resonant frequency of the Helmholtz resonator. Hence, the sensitivity of such sound generators can be increased substantially.

The sound outlet channels may be formed by slits in the housing, whereby the volume of air held in the slits forms with the volume formed with the diaphragm a Helmholtz resonator, which is advantageously tuned to the resonance of the diaphragm. By enlarging or diminishing the slits, the sound intensity and tone quality of the sound generator can be varied. To alter the slits, a slider-like member may be provided for enlarging or reducing the cross-sectional area of the slits. The slits may have a rectangular or cylindrical cross-section.

It has been found to be particularly advantageous to form the slits to have a trapezoidal cross-section. Thereby, the mean channel length of the slits becomes greater, so that the volume of the diaphragm can be diminished, and thus, the overall height can again be reduced without impairing the sound intensity of the sound generator. In addition, this slit arrangement reduces the danger of fouling the sound generator.

The sound outlet channels may be formed by slits in the body of a hand telephone. However, it is quite possible to arrange the slits of the housing of a telephone set, and it depends on each individual case on which surface of the housing they are located.

BRIEF DESCRIPTION OF THE DRAWINGS

The principles of the invention will be more readily understood by reference to the accompanying figures which represent a preferred embodiment of a sound generator constructed according to the invention.

DETAILED DESCRIPTION OF THE DRAWINGS

Figure 1:
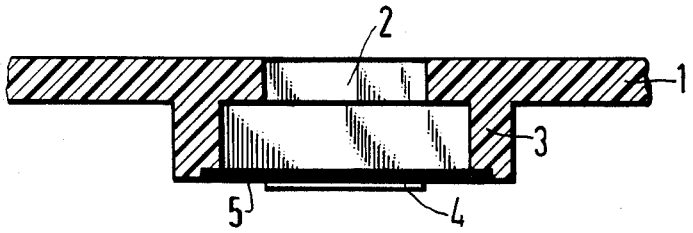
FIG. 1 is a side, cross-sectional view of a sound transducer constructed according to the invention disposed in a housing.

The sound transducer shown in FIG. 1 is disposed in a housing 1 having sound outlet channels 2. A cylindrical extension 3 of housing 1 is formed integrally therewith for use as a support for a diaphragm 5. The diaphragm is provided with a piezoelectric layer 4.

Figure 2:
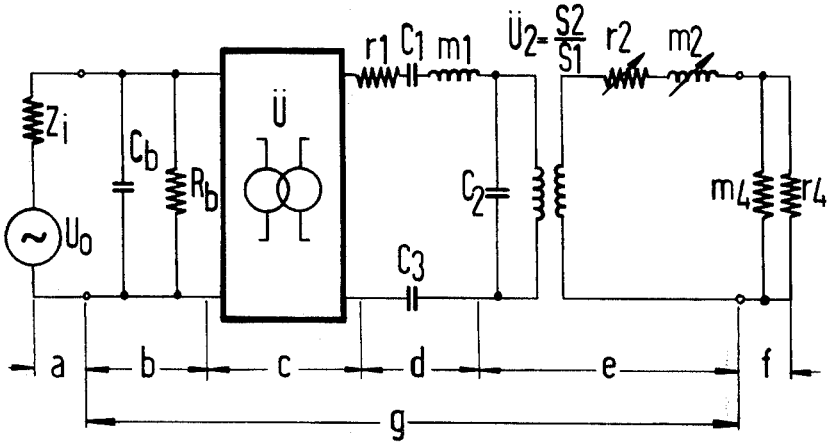
FIG. 2 is a simplified equivalent circuit schematic diagram of the sound transducer illustrated in FIG. 1.

A simplified equivalent circuit diagram is illustrated in FIG. 2 detailing the sound generator using a generator and radiation impedances. This equivalent circuit diagram can be divided into the following areas:

*a*—generator
*b*—suppressor impedance
*c*—electromechanical translator
*d*—diaphragm and the volume formed therewith
*e*—Helmholtz resonator and surface translator
*f*—radiation impedance
g—sound generator.

The diaphragm is identified by the mass *m*1, the compliance *c*1 and the friction *r*1. The antechamber V2 of the diaphragm is identified by C2 and the rear chamber by *c*3. A surface translator labeled *ü* corresponds to the ratio of the cross-sectional area of the sound outlet channels S2 to the surface area of the diaphragm S1. This element is followed by the characteristics of the sound outlet channels, which are described by the friction *r*2 and the mass *m*2. The latter components communicate with the outer volume which can be reproduced by the mass *m*4 and the friction *r*4.

Figure 3:
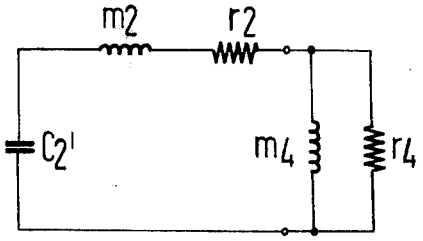
FIG. 3 is a schematic diagram of an equivalent circuit of a Helmholtz resonator formed in the FIG. 1 embodiment.

An equivalent circuit of the Helmholtz resonator is shown in FIG. 3, wherein the surface translator is marked $c2'$ and which is related to the original quantities in the equation:

$$c2' = c2 \cdot \dot{u}^2 = c2 \cdot (S2/S1)^2.$$

Figure 4:
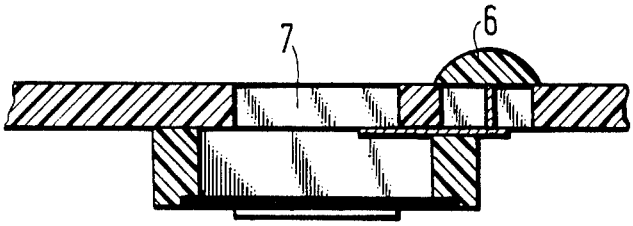
FIG. 4 is a side, cross-sectional view of an alternate embodiment of a sound transducer constructed according to the invention having variable sound intensity and tone quality.

FIG. 4 shows a sound transducer, the sound intensity and tone quality of which can be varied by means of a slider-like member 6. The size of the outlet channel 7 can be enlarged or reduced by the slider, so that the volume of the antechamber of the diaphragm can be varied.

Figure 5:
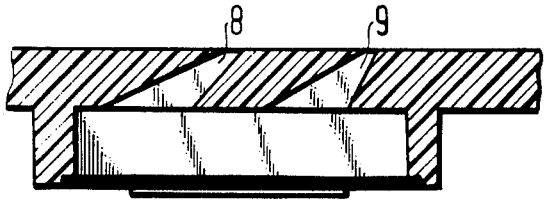
FIG. 5 is a side, cross-sectional view of a second alternate embodiment of a sound transducer constructed according to the invention provided with sloping outlet channels of the housing.

FIG. 5 shows a sound transducer having sloping outlet channels 8 and 9. The mean channel length of the sound outlet channels is enlarged with respect to an arrangement of sound outlet channels according to FIG. 4, so that a smaller volume of the sound outlet channels can be achieved. That is, the overall height can be reduced by extending the channel length.

The embodiments of the invention described hereinabove are intended only to be exemplary of the principles of the invention. It is anticipated that the described embodiments can be modified or changed while remaining within the scope of the invention, as defined by the appended claims.

I claim:

1. An electroacoustic sound generator for use with apparatus having housing means of a size determined by the space required for said apparatus, said sound generator having a diaphragm formed by a piezoelectric layer vibrating in the audio frequency range, comprising:

first and second volume portions formed in a portion of said housing means in the interior thereof, said first portion being smaller in volume than said second portion which is of a volume determined by the interior dimensions of the entirety of said housing means.

said diaphragm being disposed between said first and second volume portions forming a boundary therebetween in said housing means and means defining at least one outlet channel extending between said first volume portion and the exterior of said housing means through a wall of said housing means, said channel and said first volume portion forming a Helmholtz resonator having a resonant frequency corresponding to the desired audio frequency to be radiated, said resonant frequency being equal to the product of the compliance of said first volume portion and the square of the ratio of the cross-sectional area of said channel to the surface of said diaphragm.

2. The electroacoustic generator defined in claim 1 wherein the fundamental frequency of vibration of said diaphragm equals the resonant frequency of said Helmholtz resonator.

3. The electroacoustic generator defined in claim 1 wherein said channel is formed as slits in said housing.

4. The electroacoustic generator defined in claim 3 further comprising means for varying areas of openings of said channel.

5. The electroacoustic sound generator defined in claim 1 wherein said channel has cross-sections which are trapezoidal in shape.

* * * * *